US005908291A

United States Patent [19]

Dover et al.

[11] Patent Number: 5,908,291

[45] Date of Patent: Jun. 1, 1999

[54] CONTINUOUS CROSS-FLOW ROTARY KILN

[75] Inventors: Bruce J. Dover, Lockport; Edward V. McCormick, Churchville, both of N.Y.

[73] Assignee: Harper International Corp.

[21] Appl. No.: 09/071,394

[22] Filed: May 1, 1998

[51] Int. Cl.[6] ..... F27B 7/08; F27B 7/10

[52] U.S. Cl. ..... 432/107; 432/103; 432/105; 432/112; 432/117; 34/131; 34/132

[58] Field of Search ..... 432/103, 105, 432/107, 109, 112, 114, 117; 34/131, 132, 595, 135, 136, 137; 110/246

[56] References Cited

U.S. PATENT DOCUMENTS

| | | | |
|---|---|---|---|
| 892,901 | 7/1908 | Schwartz | 34/131 |
| 1,596,977 | 8/1926 | Klingler | 34/131 |
| 3,584,609 | 6/1971 | Lerner et al. | 110/246 |
| 3,736,887 | 6/1973 | Wiedermann | 110/246 |
| 3,741,717 | 6/1973 | Triplett | 432/105 |
| 3,822,651 | 7/1974 | Harris et al. | 110/246 |
| 3,838,015 | 9/1974 | Buchbinder et al. | 110/246 |
| 3,938,450 | 2/1976 | Jaronko et al. | 110/246 |
| 4,191,530 | 3/1980 | Bearce | 432/107 |
| 4,334,366 | 6/1982 | Lockwood | 432/105 |
| 4,376,343 | 3/1983 | White et al. | 432/107 |
| 4,393,603 | 7/1983 | Casperson | 432/107 |
| 5,088,210 | 2/1992 | Goe | 34/132 |
| 5,152,233 | 10/1992 | Spisak | 110/246 |
| 5,566,469 | 10/1996 | Bolton et al. | 34/135 |

*Primary Examiner*—Teresa Walberg
*Assistant Examiner*—Jiping Lu
*Attorney, Agent, or Firm*—Arthur S. Cookfair; James J. Ralabate

[57] ABSTRACT

A direct heat rotary calciner and method for providing improved thermal treatment of particulate material comprises a rotary tube having a plurality of screened apertures along the length thereof. Material to be treated is passed through the rotating tube and contacted during passage with a cross-flow of heated gases entering and leaving through the screened apertures. At least a portion of the internal wall of the tube may be provided with spiral flights to aid in the conveyance of the particulate material through the rotating tube.

12 Claims, 3 Drawing Sheets

CONTINUOUS CROSS-FLOW ROTARY KILN

BACKGROUND OF THE INVENTION

1. Field of the Invention

This invention relates to a rotary kiln adapted for the treatment, such as drying or calcination, of particulate materials by direct heat.

2. Prior Art

Generally, directly heated rotary kilns are commonly employed to dry and/or calcine solid particles such as sand, gravel, limestone, dolomite, magnesite, fertilizers, various metal oxides, and the like. Typically, such kilns are in the form of an elongated rotating cylinder, inclined slightly from the horizontal. The particulate solids to be treated, enter at one end of the kiln and, under the influence of gravity, move toward the other end where the treated product is discharged. Such kilns frequently utilize a method of heat transfer in which solids, especially particulate solids, are heated by direct contact with hot gases. In most direct heat rotary dryers or kilns, heated gases are passed through, either in the same direction as that of the movement of the particulate solids or in a counterflow direction. Typically, the kiln is slowly rotated about its axis and is tilted or inclined slightly from horizontal to effect a tumbling of the solids and a general forward motion while hot gases, e.g. combustion gases are passed from one end of the kiln to the other and caused to flow over the moving solids. As the drum rotates, the bed of particles is carried or dragged upwardly by friction along the inner surface of the drum until the weight of the particles and the steepness of the slope of particle bed overcomes friction and the particles begin to slide or tumble downwardly to the bottom of the particle bed. This tumbling action continues and the particle bed moves slowly forward as the drum continues to rotate. In such a process mixing is relatively poor, with the result that particles of varying sizes are not equally contacted or exposed to the gases. The efficiency of heat transfer from gas to particulate solids is relatively low.

It is known to improve the efficiency through the use of lifting flights attached to the interior wall of the rotating drum. As the drum rotates the lifting flights serve to lift the particles from the bed and then allow them to fall as a shower through the stream of gases as it passes through the kiln. Although thermal efficiency is improved, for some materials, for example, titanium dioxide, the repeated lifting and falling may result in the production of large amounts of fines and dust which may become entrained in the gas stream, resulting in a loss of material and a potential environmental hazard as the dust-laden gases are passed to the atmosphere.

It is also known to pass the hot gases into a direct heat rotary dryer, through the particle bed, in a counter-flow direction, using a Roto-Louvre dryer, wherein hot gases are blown through louvers in a double-wall rotary cylinder and up through the moving bed of particulate solids.

U.S. Pat. No. 1,185,899 discloses a hot air dryer comprising a rotatable cylinder extending through a firebox and means for passing heated air from the firebox lengthwise through the cylinder. The passage of the material to be dried, through the cylinder, is aided by a plurality of flights disposed within the cylinder.

U.S. Pat. No. 3,799,735 discloses the treatment of particulate material with counterflow of combustion gases in a rotary kiln wherein the kiln includes trough shaped conveyor flights. As the particles move along the kiln, they are alternately lifted and dropped to form clouds of parallel vertical curtains through which the combustion gases are passed.

U.S. Pat. No. 4,535,550 discloses a method and apparatus for processing particulate material by passing the material through ah inclined rotary cylinder while the material is contacted with a stream of gas. The gas is introduced into the particle bed through a series of internal supply pipes.

U.S. Pat. No. 5,312,599 discloses a rotary furnace apparatus for the manufacture of activated carbon wherein a rotating bed of particulate material is heated by indirect heating while a controlled flow of sweep gas contacts the surface of the moving particle bed. The sweep gas is introduced through a series of orifices in a sparger tube extending along the length of and within the furnace structure. The gas sweeps across the surface of the particle bed in a direction not parallel to the direction of movement of the bed and exits through a series of inlet ports in an opposing exhaust tube.

SUMMARY OF THE INVENTION

It is an object of the present invention to provide a novel cross-flow rotating kiln suitable for mixing, drying, cooling, heating, or calcining various materials to produce a uniformly treated product with minimal formation of fines and dusts.

It is an object of the present invention to provide a method and apparatus for the drying and/or calcining of materials, utilizing a novel cross-flow rotary kiln.

It is a further object to provide a method and apparatus for the drying and/or calcining of particulate solids having improved efficiency in mass transfer.

It is a further object to provide a method and apparatus for the drying and/or calcining of particulate solids having improved efficiency in heat transfer.

It is a still further object to provide a method and apparatus for the drying and/or calcining of particulate solids by contact with a stream of hot gases, wherein the loss of material by entrainment of dusts in the stream of hot gases is minimized.

These and other objects are accomplished in accordance with the method and apparatus of the present invention for the treatment of particulate materials. The apparatus of this invention comprises a directly heated rotary kiln in the form of a tube or cylinder, adapted for the movement of particulate materials therethrough and having a multiplicity of screened openings along the length thereof for the entry and exit of gases to effect a cross-flow contact of the gases with the particulate material during movement. In practice, the material to be treated, for example, a particulate solid, enters one end of the rotating kiln, is conveyed along the length of the rotating kiln while gases are passed through the moving particles in a cross-flow direction, and the treated material exits the kiln at the other end. The movement of the rotating bed of particulate materials along the length of the kiln may be effected in a conventional manner by tilting or inclining the kiln slightly from horizontal and allowing the influence of gravity to govern the movement. The residence time of the moving material may be controlled by degree of tilt. In a preferred mode, the lengthwise movement of the rotating bed and the residence time are ore readily controlled by use of internal spiral flights.

Thermal Processing of some materials, e.g. pearlescent pigments, requires substantial gas-solid contact. The material must be dried and freed of all residual acids. Uniform partial sintering, to produce strongly colored flakes, also requires extremely uniform thermal history throughout the material. This level of thermal uniformity is achieved in the rotary kiln (tube) of this invention with the use of integral spiral flights. By means of the spiral flights the residence time of the material being treated is controlled, since the material is confined to segments of a helix of the flights without mixing with adjacent materials.

In addition, since the spiral flights are attached to the inner wall of the rotary kiln and thus rotate in concert with the rotating kiln, the materials are conveyed in a relatively smooth manner and not subjected to abrasion or attrition between stationary and moving surfaces as would occur, for example, with a screw conveyor. In a preferred embodiment, the inner part of the spiral flights is attached to a central tube, thereby forming a helical channel between the inner wall of the kiln and the outer wall of the central tube. This embodiment results in a smoother forward movement of the material being treated and minimizes the formation of fines, thus minimizing the potential for entrainment of fines in the gases with the associated problems of air pollution and/or removal and recovery of the entrained fines from the exhaust gases. Furthermore, this preferred embodiment allows better control of residence time.

The gases are introduced and exited through screened apertures in the wall of the kiln. The gases may be introduced at various temperatures depending on the desired treatment and may be used for cooling or heating. In some instances cooling gases may be introduced at one point and heating gases at another point during the same treatment.

In some treatments, the material being treated may be self-heating due to chemical reaction. Furthermore, in some instances, the material being treated may be heated directly by radiant energy, for example, from a radiant heat source located within the kiln. The heated material may then transfer the heat to the gas which, in turn, may be used further upstream or downstream to transfer the heat to the material being treated. In this instance it may not be necessary to provide other heating means, for example, for external heating of the gases. In a similar manner, other energy sources, such as a microwave generator, may be placed within the kiln to provide heat or to promote conditions for various chemical reactions.

The size and shape of the apertures may vary but, will preferably be holes of uniform size and of a diameter not in excess of ¼ of the diameter of the kiln. Each opening may be individually screened. However, in a preferred manner, the screen is provided in the form of a single screen, fabricated in tubular form and sized to fit closely either to the external wall or, most preferably, to the internal wall of the kiln, and attached thereto. The screen may be of any suitable composition and size, depending on the particular material being processed and the conditions, such as temperature, atmosphere and the like, required or inherent in the process. For example, in one embodiment, the screen is a 300 mesh 316SS alloy woven wire screen. The screen may be backed up by an expanded metal (e.g. 309 or 330) screen with an average hole size of the order of about 10 mm. The screen assembly is inserted into a rotary kiln structure, such as a centrifugally cast, machined, high temperature alloy (e.g. Duralloy HT) tube. The latter is a type of material which might be selected for construction of a comparable conventional rotary kiln.

BRIEF DESCRIPTION OF THE DRAWINGS

The invention is further illustrated and explained in detail by reference to the accompanying drawings wherein.

DETAILED DESCRIPTION OF THE DRAWINGS

Figure 1:
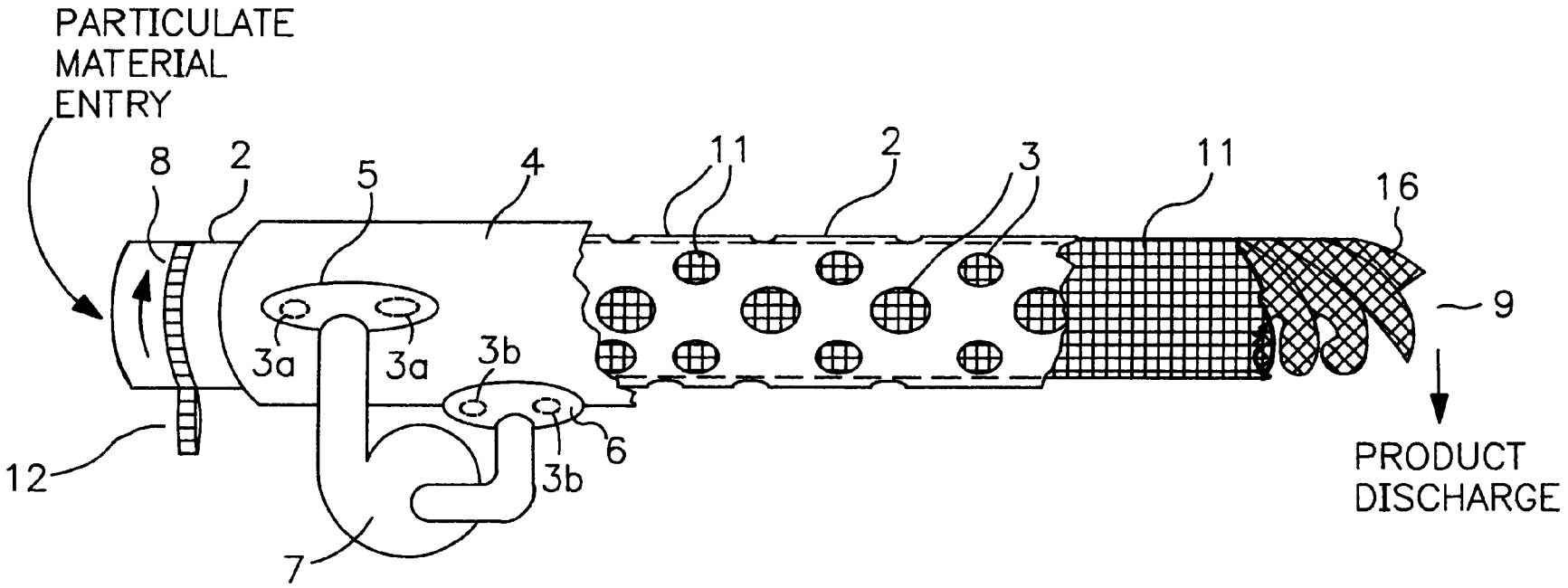
FIG. 1 is a perspective view of an embodiment of a continuous cross-flow rotary kiln of this invention with internal portions shown in partial cutaways.

FIG. 1 depicts a cross-flow rotary kiln 1 of this invention including a tube 2 having screened apertures 3 along its length. A cylindrical screen 11 is fixed against the inner wall of tube 2 to provide a screened protection at each of the screened apertures 3. The screen 11 permits gas flow therethrough, but is fine enough to retain the particles being treated in the kiln. A protective cylindrical housing 4, shown in cutaway in FIG. 1, holds inlet manifold 5 and exhaust manifold 6, positioned in alignment with screened apertures 3*a* and 3*b*, respectively, to allow the cross-flow entry and exit of gases in response to blower 7. The protective cylindrical housing 4 forms a close fit around tube 2 and serves to eliminate or minimize leakage or unwanted exiting of the gases from the ends of the kiln, or from apertures that are not in position to receive or emit gases from inlet manifold 5 or exhaust manifold 6. In practice, tube 2 is rotated in response to trunion gear 12; particulate material to be treated is fed into the tube at upstream end 8 forming a particle bed 10 within the tube (see FIG. 2). The tumbling particles are retained by cylindrical screen 11 which provides the screen for screened apertures 3. As tube 2 rotates, particle bed 10 is tumbled and moved forward by spiral flights 16 toward downstream end 9 where the treated product is discharged. As will be seen from FIG. 2, the inlet manifolds 5 and exhaust manifolds 6 are positioned to provide a cross-flow of gas from inlet manifold 5, into tube 2 through screened aperture 3*a* and through the particle bed 10, exiting through screened aperture 3*b* and exhaust manifold 6. The flow of gases is in response to blower 7 which may produce a positive pressure at inlet manifold 5 and a negative pressure at outlet manifold 6.

Figure 2:
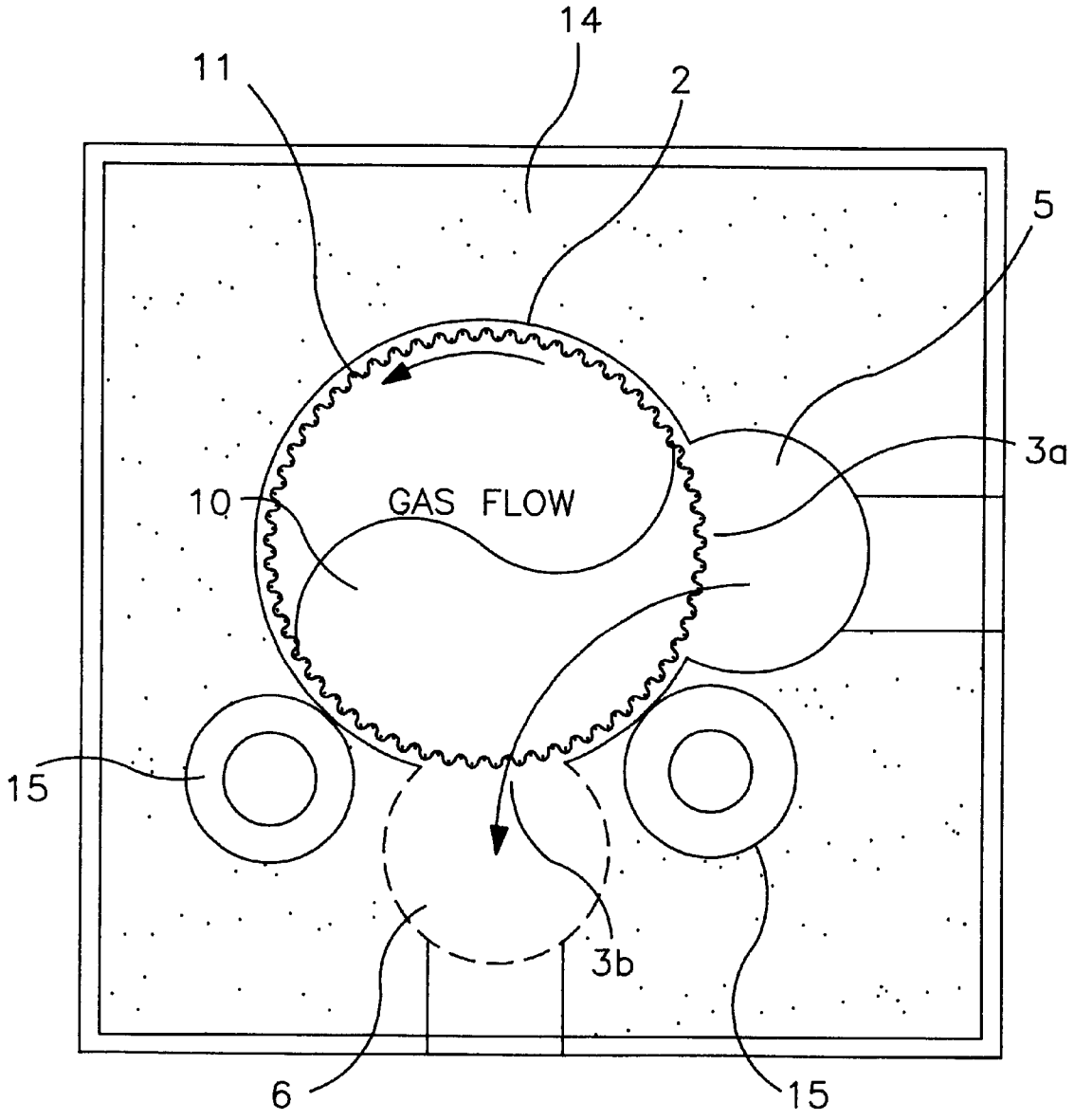
FIG. 2 is a cross-sectional end view of a cross-flow rotary kiln of this invention with means for effecting a cross-flow of gases through a rotating bed of particulate solid.

The apparatus depicted in cross-section in FIG. 2 is similar to that shown in FIG. 1, except that spiral flights are omitted and an alternate embodiment of the protective cylindrical housing is shown. In FIG. 2, the insulation material 14, such as insulating castable refractory, is configured to an internal cylinder of close tolerance, around tube 2 and serves as the protective cylindrical housing, functioning as described herinabove. The manifolds 5 and 6 may, for example, be of cast metal and set into the insulation material 14 or, if a castable refractory is used, the manifolds may be formed in the insulation material.

The term "cross-flow" as used herein refers to a flow substantially transverse to the axis of rotation of the kiln and thus substantially perpendicular to the traditional longitudinal flow of the prior art processes employing co-current or counter-current flow. Compared to the prior art processes utilizing co-current or counter-current gas flow, the cross-flow of gases in accordance with the method and apparatus of the present invention provides better gas-solid contact and, depending on the particular treatment employed, better heat transfer and improved energy efficiency. The method and apparatus of the present invention may be used for a variety of treatments, including drying, calcining, and various chemical reactions e.g. reduction, oxidation, and the like.

Figure 3:
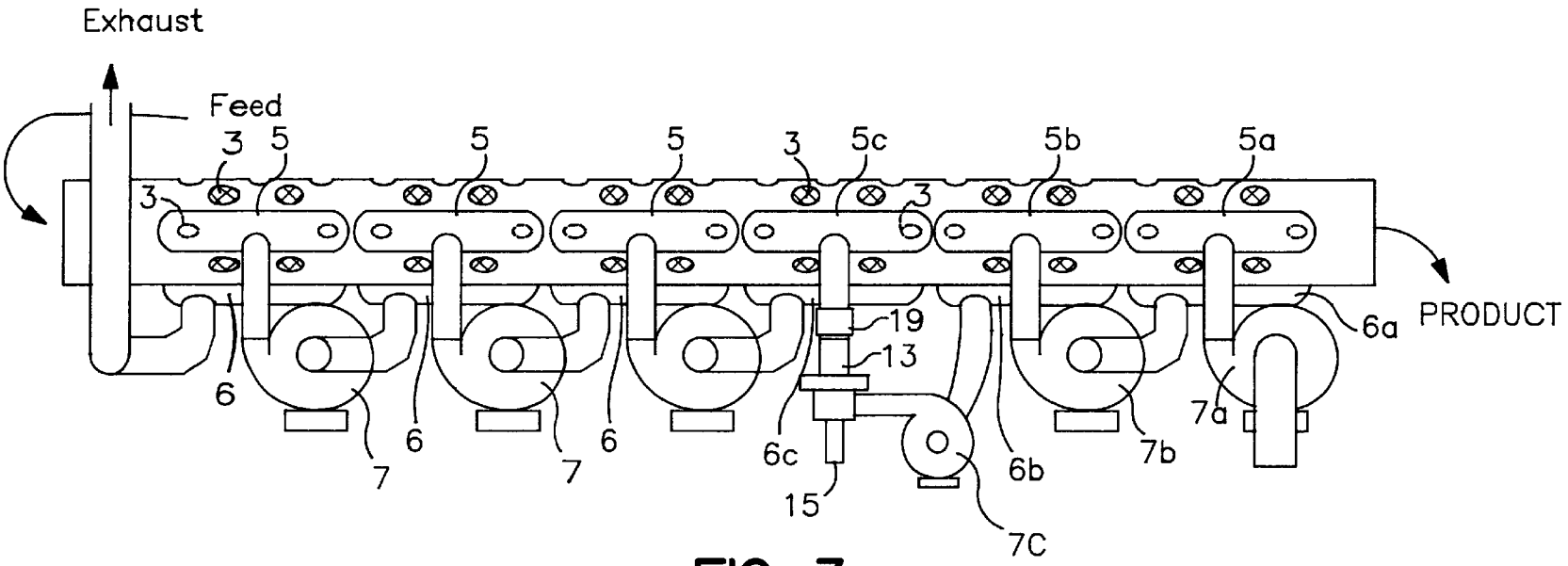
FIG. 3 is perspective view of an embodiment of a continuous cross-flow rotary kiln of this invention with attachments for the inlet and outlet of gases.

FIG. 3 shows an embodiment of the cross-flow rotary kiln of this invention having a multiplicity of inlet manifolds 5 and exhaust manifolds 6, respectively aligned with screened apertures 3, along the length of tube 2. In the positions shown, the inlet manifolds 5 are aligned with screened apertures at the side of tube 2 and the exhaust manifolds 6 are aligned with screened apertures at the bottom of tube 2. Gas entering an inlet manifold 5 follows a cross-flow path through the particle bed 10 and exits at the opposing exhaust manifold 10. (Similar positioning is depicted in cross-section in FIG. 2). In the embodiment shown in FIG. 3, at least two different gas treatments are employed. Inlet manifolds 5*a* and 5*b* are directing a cross-flow of cooling gas, e.g., cool air, from blowers 7*a* and 7*b*,respectively, to cool the particulate product prior to discharge. The cooling gas entering at 5*a* exits through manifold 6*a* and is returned to the kiln by blower 7*b* through manifold 5*b*, exiting through manifold 6*b*. From there the gas is transmitted by blower 7*c* to pipe 13 and then through inlet manifold 5*c*. The gases entering inlet manifold 5*c* may be heated, for example, by a heating unit (not shown) at pipe 13. In a process such as that depicted in FIG. 3, energy utilization is optimized since considerable heat has already been transferred to the gas used to cool the product prior to discharge and thus less heat will have to be added when the gas is used for heating purposes. The gases may be heated by electric or gas means, or other. Alternatively, hot combustion gases may be introduced through inlet 15. If additional heat or treatment other than heat is desired upstream of manifold 5*c*, or at other positions along the length of the kiln, a unit such as pipe 13, with inlet 15, may be incorporated in a similar manner at such location.

Figure 4:
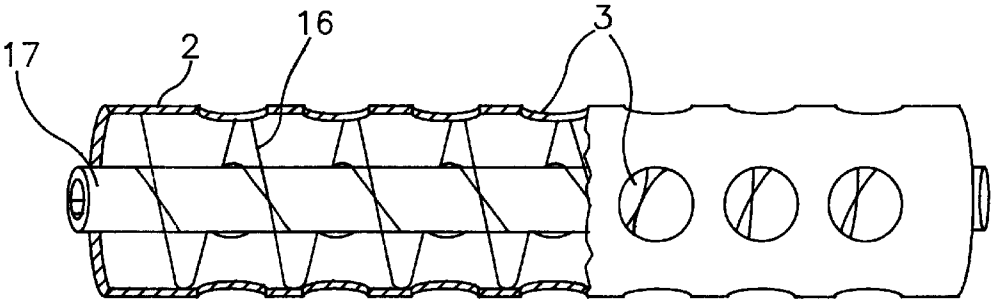
FIG. 4 is a side view in partial cut-away, depicting as preferred embodiment of the invention.

FIG. 4 depicts a preferred embodiment of the invention wherein the inner part of spiral flights 16 is attached to the outer wall of a central tube 17. In the drawing, the spiral flights 16 are shown in outline form and the screen has been omitted to show the central tube 17 in better detail. In this embodiment, as tube 2 is rotated, the particulate material being treated is moved forward with the aid of the spiral flights 16, through a helical path in a channel defined by the inner wall of tube 2, the outer wall of central tube 17, and the spiral flights 16. In an embodiment where a cylindrical screen, internal to tube 2 is employed to provide the screen for screened apertures 3 (as in FIG. 1), the outer portion of spiral flights 16 may be attached to the inner surface of the cylindrical screen which, in turn, is attached to the inner wall of tube 2. In another embodiment (not shown), all or part of the heat required for a thermal treatment, may be provided by a heat source within central tube 17.

While certain preferred embodiments of the present invention have been described herein and shown in the accompanying drawings, it will be understood that various modifications may be made without departing from the spirit and scope of the invention.

What is claimed is:

1. An apparatus for the treatment of particulate material comprising:

a directly heated rotary cylinder adapted for the movement of particulate material therethrough and having a multiplicity of screened apertures along the length thereof;

a multiplicity of gas inlet manifolds each with a corresponding gas outlet manifold, fixedly positioned in a stationary protective housing along the length of said rotary cylinder, in alignment with the screened apertures so that gas from an inlet manifold enters through at least one of said screened apertures and exits through at least one other of said screened apertures to the corresponding gas outlet manifold to effect a cross-flow of gas, contacting said particulate material in a path substantially transverse to the longitudinal axis of said rotary cylinder;

said protective housing having an internal cylindrical configuration and being closely fit around said rotary cylinder to inhibit leakage or flow of gas from said rotary cylinder at locations other than through the screened apertures with which said gas inlet manifolds and gas outlet manifolds are in alignment.

2. An apparatus according to claim 1 wherein the said rotary kiln is inclined from horizontal to effect the movement of particulate material therethrough by gravity.

3. An apparatus according to claim 1 wherein said rotary kiln includes internal spiral flights to impart movement of particulate material therethrough during rotation of said rotary kiln.

4. An apparatus according to claim 1 wherein said flow of gas passes through said particulate material at a point adjacent to said inlet manifold and at a point adjacent to said outlet manifold.

5. An apparatus according to claim 1 wherein said rotary kiln is a metal cylinder.

6. An apparatus according to claim 1 wherein said protective housing is made of metal.

7. An apparatus according to claim 1 wherein said protective housing is made of a heat insulating material.

8. An apparatus according to claim 1 wherein said multiplicity of gas inlet manifolds and corresponding gas outlet manifolds constitute a series of sets, each set consisting of a gas inlet manifold and a corresponding gas outlet manifold, and having a blower means provided between adjacent sets to effect the passage of gas from the gas outlet manifold of one set to the gas inlet manifold of an adjacent set for the recycling of gas.

9. An apparatus according to claim 8 wherein at least one of said gas inlet manifolds is provided with means for heating gas.

10. An apparatus according to claim 8 wherein at least one of said gas inlet manifolds is provided with means for introducing additional gas.

11. An apparatus according to claim 10 wherein the introduction of said additional gas provides additional heat or treatment other than heat.

12. An apparatus for the thermal treatment of particulate materials comprising:

a directly heated cylindrical rotatable kiln having integral spiral flights for the movement of particulate materials therethrough from an upstream end to downstream end;

a multiplicity of apertures along the length thereof;

a tubular screen on an inside wall of said rotatable kiln, said tubular screen providing a screen cover over said apertures and having openings of a mesh that contains said particulate material, but permits the passage of gases therethrough;

a multiplicity of gas inlets and gas outlets fixedly positioned in a stationary protective housing fit around an outer surface of said rotatable kiln, each gas inlet being in fluid communication with a gas outlet through a cross-flow of gas in a direction substantially transverse to the longitudinal axis of said rotatable kiln;

one or more blowers suitable for controlling said cross-flow of gas; and said protective housing surrounding said rotatable kiln acting to prevent leakage or undesired exiting of gas;

said protective housing and said gas inlets and gas outlets being fixed with respect to said rotatable kiln and said apertures being aligned with said gas inlets and gas outlets so that during rotation of said rotatable kiln, when an aperture is aligned with a gas inlet another aperture is aligned with a corresponding gas outlet.

* * * * *